US009103551B2

(12) United States Patent
Berry et al.

(10) Patent No.: US 9,103,551 B2
(45) Date of Patent: Aug. 11, 2015

(54) COMBUSTOR LEAF SEAL ARRANGEMENT

(75) Inventors: Jonathan Dwight Berry, Simpsonville, SC (US); Heath Michael Ostebee, Piedmont, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 1024 days.

(21) Appl. No.: 13/195,394

(22) Filed: Aug. 1, 2011

(65) Prior Publication Data

US 2013/0032643 A1 Feb. 7, 2013

(51) Int. Cl.
*F23R 3/28* (2006.01)

(52) U.S. Cl.
CPC ..... *F23R 3/283* (2013.01); *F23R 3/286* (2013.01); *F23R 2900/00012* (2013.01)

(58) Field of Classification Search
CPC ..... F23R 3/002; F23R 3/04; F23R 3/06; F23R 3/28; F23R 3/283; F23R 3/286; F23R 3/34; F23R 3/60; F23R 2900/00012; F01D 9/023; F01D 11/005; F02C 7/20; Y02T 50/675
USPC ..... 60/737, 740, 748, 752, 756, 796; 415/174.2
See application file for complete search history.

(56) References Cited

U.S. PATENT DOCUMENTS

| | | | | |
|---|---|---|---|---|
| 4,587,809 | A | 5/1986 | Ohmori et al. | |
| 4,692,565 | A | 9/1987 | Koht et al. | |
| 5,118,120 | A | 6/1992 | Drerup et al. | |
| 5,274,991 | A | 1/1994 | Fitts | |
| 5,402,634 | A | 4/1995 | Marshall | |
| 5,431,018 | A | 7/1995 | Keller | |
| 5,452,574 | A | 9/1995 | Cowell et al. | |
| 5,724,816 | A | 3/1998 | Ritter et al. | |
| 6,070,411 | A | 6/2000 | Iwai et al. | |
| 6,164,656 | A | 12/2000 | Frost | |
| 6,334,310 | B1 | 1/2002 | Sutcu et al. | |
| 6,351,947 | B1 | 3/2002 | Keller et al. | |
| 6,427,446 | B1 | 8/2002 | Kraft et al. | |
| 7,082,766 | B1 | 8/2006 | Widener et al. | |
| 7,090,224 | B2 * | 8/2006 | Iguchi et al. | 277/603 |
| 7,343,745 | B2 | 3/2008 | Inoue et al. | |
| 7,752,850 | B2 | 7/2010 | Laster et al. | |
| 2003/0110774 | A1 | 6/2003 | Saitoh | |
| 2005/0268617 | A1 | 12/2005 | Amond et al. | |
| 2007/0102235 | A1 | 5/2007 | Tobik et al. | |
| 2008/0007008 | A1 | 1/2008 | Hoebel et al. | |

(Continued)

OTHER PUBLICATIONS

Laster et al., "Catalytic Combustor for Fuel-Flexible Turbine (DE-FC26-03NT41891), Final Report Phase 2, Oct. 4, 2004 through Oct. 2007 for U.S. Department of Energy, Office of Fossil Energy, National Energy Technology Laboratory, 3610 Collins Ferry Road, Morgantown, West Virginia 26507-0880", 50 pages, Siemens Power Generation, Inc., Orlando, FL, USA.

(Continued)

*Primary Examiner* — Gerald L Sung
*Assistant Examiner* — Scott Walthour
(74) *Attorney, Agent, or Firm* — Nixon & Vanderhye, P.C.

(57) ABSTRACT

A substantially wedge-shaped sector nozzle includes a nozzle body having inner and outer arcuate segments connected by diverging radial side plates and a nozzle plate at an aft end of the nozzle body formed with an array of fuel orifices. One of the diverging radial side plates supports a radially-oriented leaf seal assembly adapted to seal against a flat plate of an adjacent similarly-shaped sector nozzle.

21 Claims, 6 Drawing Sheets

(56) References Cited

U.S. PATENT DOCUMENTS

| | | | | |
|---|---|---|---|---|
| 2008/0078180 | A1 | 4/2008 | Durbin et al. | |
| 2008/0289340 | A1 | 11/2008 | Oda et al. | |
| 2008/0302105 | A1 | 12/2008 | Oda et al. | |
| 2009/0169370 | A1* | 7/2009 | Morgan et al. | 415/174.2 |
| 2009/0188255 | A1* | 7/2009 | Green et al. | 60/737 |
| 2009/0223227 | A1 | 9/2009 | Lipinski et al. | |
| 2010/0077760 | A1 | 4/2010 | Laster et al. | |
| 2010/0186413 | A1 | 7/2010 | Lacy et al. | |
| 2010/0218501 | A1 | 9/2010 | York et al. | |
| 2010/0263382 | A1 | 10/2010 | Mancini et al. | |
| 2010/0300106 | A1 | 12/2010 | Edwards et al. | |
| 2011/0179795 | A1 | 7/2011 | Johnson et al. | |
| 2011/0197586 | A1 | 8/2011 | Berry et al. | |
| 2013/0025283 | A1 | 1/2013 | Berry et al. | |
| 2013/0032643 | A1 | 2/2013 | Berry et al. | |
| 2013/0305725 | A1* | 11/2013 | Berry | 60/746 |
| 2013/0305739 | A1* | 11/2013 | Berry | 60/785 |

OTHER PUBLICATIONS

Laster, "Catalytic Combustor for Fuel-Flexible Turbine, Cooperative Agreement No. (DE-FC26-03NT41891), Technical Progress Report Rev. 1, Oct. 4, 2004 through Mar. 2005 for U.S. Department of Energy, Office of Fossil Energy, National Energy Technology Laboratory, 3610 Collins Ferry Road, Morgantown, West Virginia 26507-0880", 21 pages, Siemens Westinghouse Power Corporation, Orlando, FL, USA.

U.S. Appl. No. 13/475,882 (pending).

U.S. Appl. No. 13/195,394 (pending).

U.S. Appl. No. 13/194,178 (pending).

U.S. Appl. No. 13/475,887 (pending).

Laster, W.R., Catalytic Combustor for Fuel-Flexible Turbine Technical Progress Report; Rev. 1; Feb. 10, 2007, Morgantown, West Virginia.

U.S. Appl. No. 13/109,294 (abandoned).

* cited by examiner

COMBUSTOR LEAF SEAL ARRANGEMENT

This invention relates generally to gas turbine combustor technology and, more specifically, to minimizing cooling air leakage between adjacent wedge-shaped combustor nozzles.

BACKGROUND OF THE INVENTION

In certain gas turbine combustors, spring-loaded leaf seals are used to seal between two concentric surfaces, for example, between the combustor liner and surrounding flow sleeve (see, for example, commonly owned U.S. Pat. No. 6,427,446). These seals are often referred to as "hula seals" in that they consist of a series of short, pre-bent leaf seals formed into a circle. In certain combustor nozzle arrangements, a plurality of wedge-shaped sector nozzles (sometimes referred to herein as "sector nozzles") are arrayed in annular fashion about a center nozzle, with radially-oriented side plates of the adjacent sector nozzles closely adjacent one another. There is a need for a way to seal between the side plates of adjacent sector nozzles, a task made more difficult by the use of hula seals on the center nozzle about which the sector nozzles are arranged, as well as on the inner surface of the surrounding combustor liner.

BRIEF DESCRIPTION OF THE INVENTION

In a first exemplary but nonlimiting aspect, there is provided a substantially wedge-shaped sector nozzle comprising a nozzle body having inner and outer arcuate plates connected by diverging radially-oriented side surfaces and a nozzle plate at an aft end of the nozzle body formed with an array of fuel orifices; one of the diverging radially-oriented side surfaces supporting a radially-oriented leaf seal adapted to seal against a flat surface of an adjacent similarly-shaped sector nozzle.

In another exemplary but nonlimiting aspect, there is provided a seal assembly for use with a wedge-shaped sector nozzle of a gas turbine combustor, the seal assembly comprising a plurality of substantially parallel spring fingers joined along a solid edge extending substantially perpendicularly to the plurality of substantially parallel spring fingers, and a pair of relatively rigid inner and outer plates attached at opposite ends of the solid edge.

In still another exemplary but nonlimiting aspect, the invention relates to a pair of turbine sector nozzles each comprising inner and outer arcuate segment walls connected by diverging, radially-oriented side plates, wherein one of said radially oriented side plates supports a radially-oriented leaf seal assembly engaged against a flat surface of an adjacent similarly-shaped sector nozzle.

The invention will now be described in connection with the drawings identified below.

DETAILED DESCRIPTION OF THE INVENTION

Figure 1:
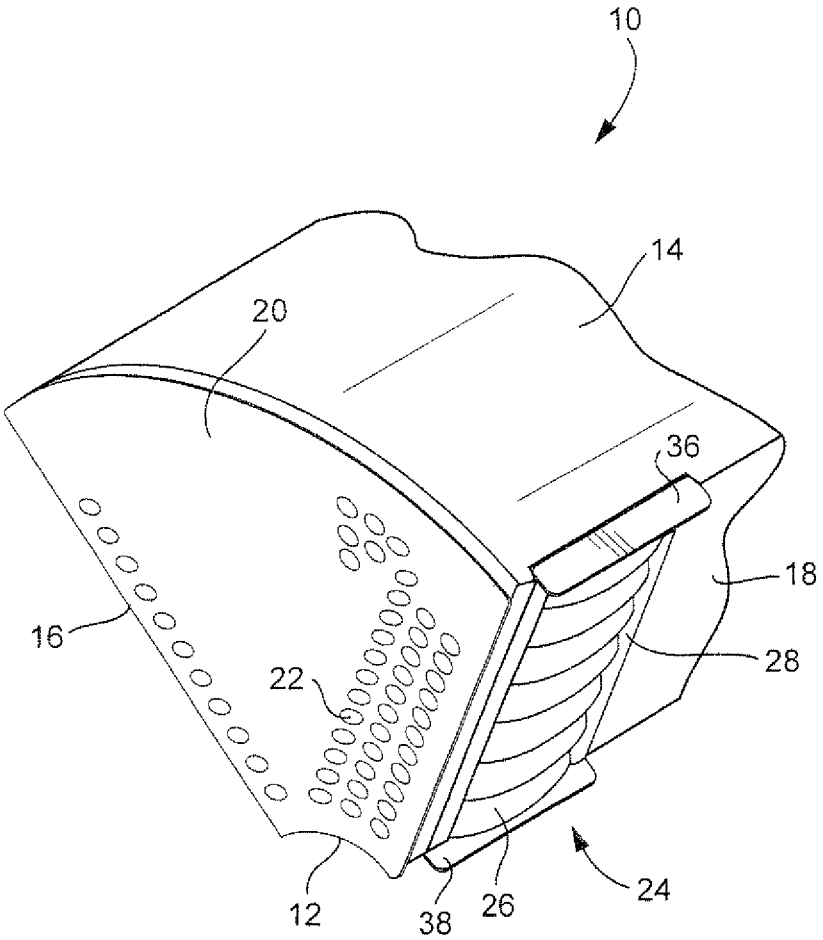
FIG. 1 is a partial perspective view of a sector nozzle for a turbine combustor including a side plate leaf seal in accordance with an exemplary but nonlimiting embodiment.
Figure 2:
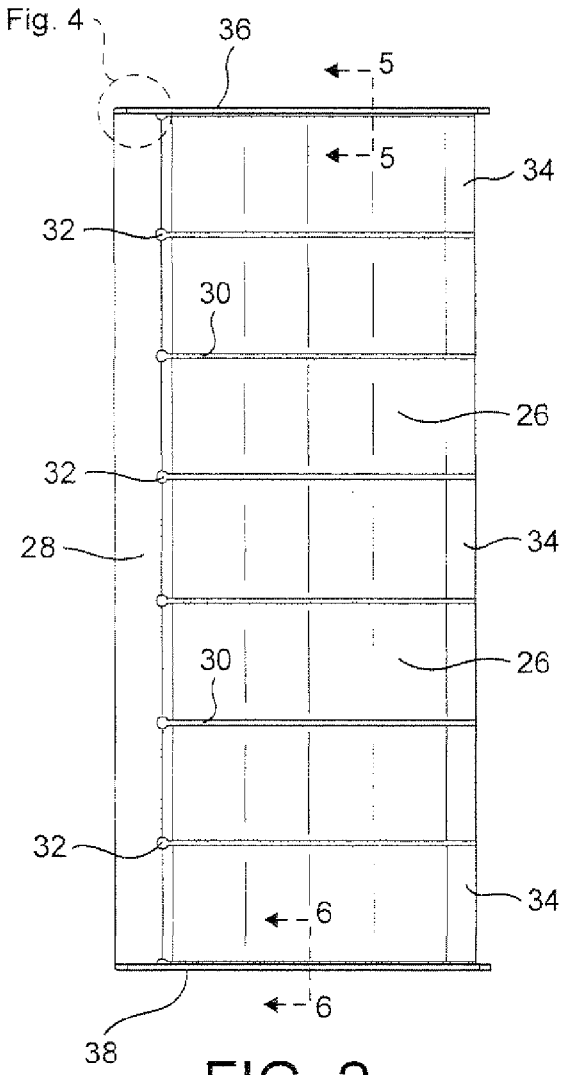
FIG. 2 is a side elevation of the leaf seal shown in FIG. 1.
Figure 3:
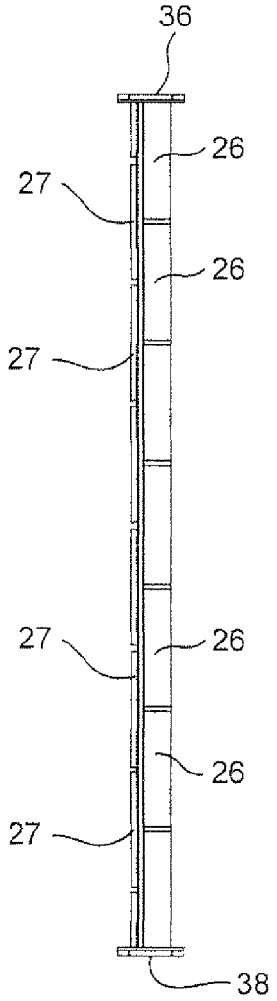
FIG. 3 is and end elevation of the leaf seal shown in FIG. 2.
Figure 4:
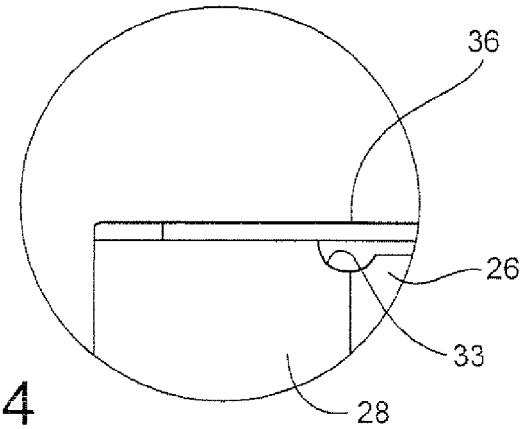
FIG. 4 is an enlarged detail taken from FIG. 2.
Figure 5:
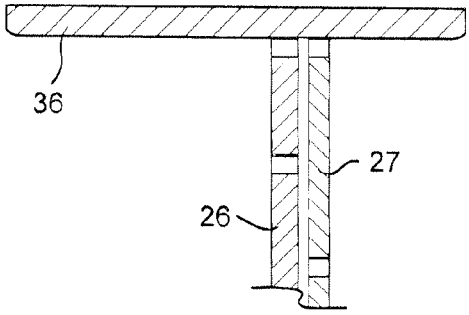
FIG. 5 is a section taken along the line 5-5 in FIG. 2.
Figure 6:
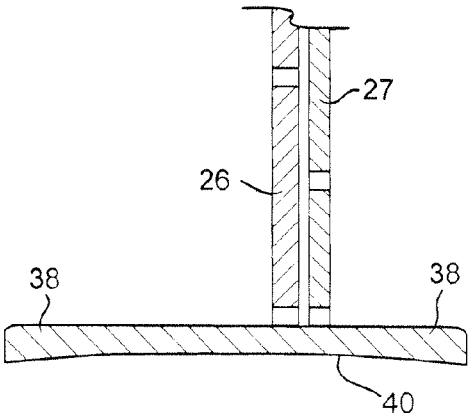
FIG. 6 is a section taken along the line 6-6 in FIG. 2.
Figure 7:
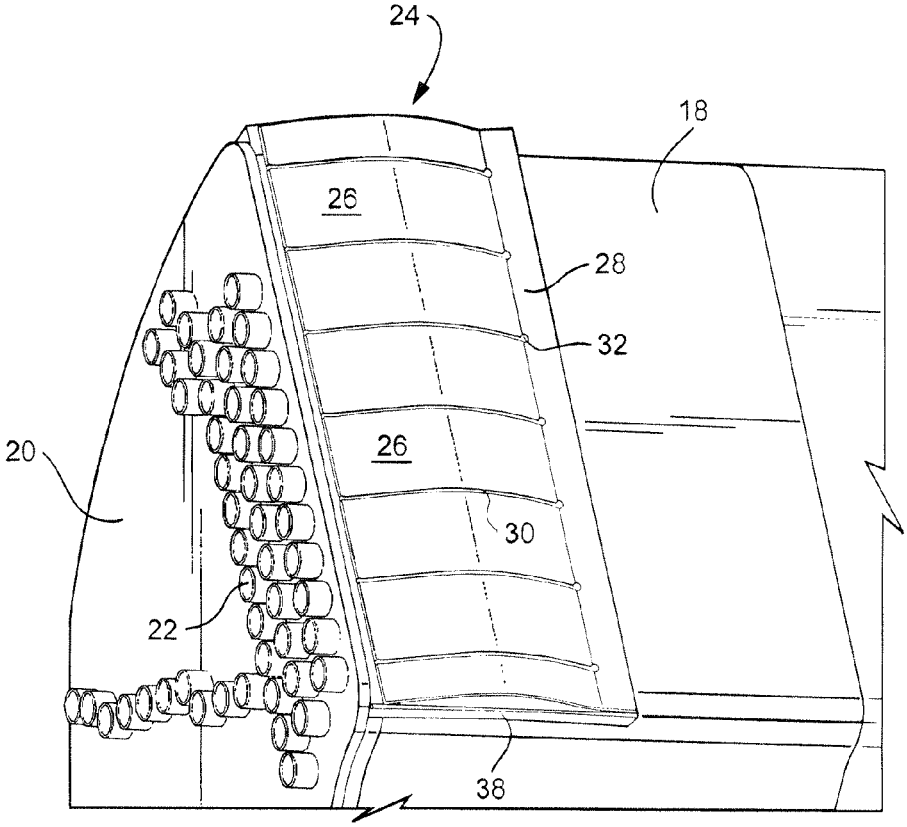
FIG. 7 is another partial perspective view of the sector nozzle and side plate seal shown in FIG. 1.
Figure 8:
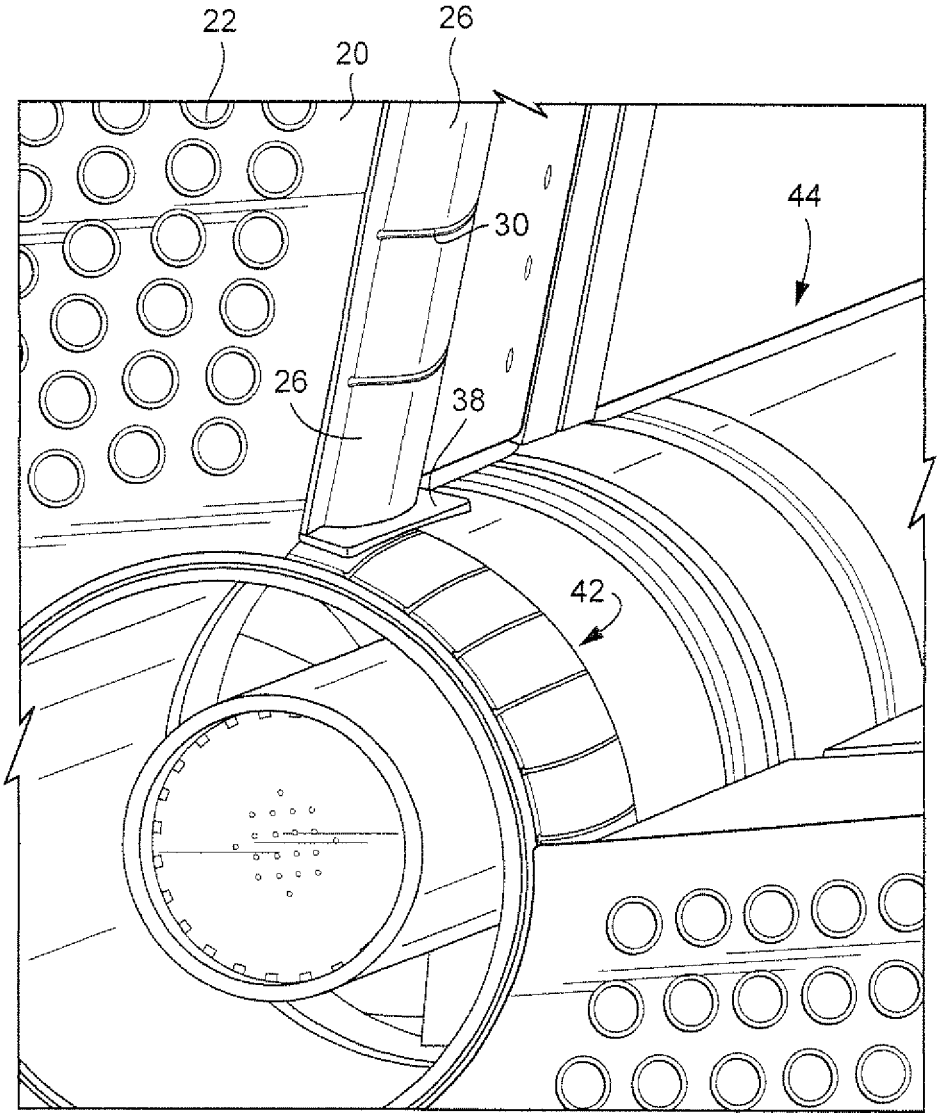
FIG. 8 is still another partial perspective view of the sector nozzle and side plate seal, showing the interaction between the side plate seal and a hula seal secured about the center nozzle.

With reference initially to FIG. 1, a sector nozzle 10 for a gas turbine combustor comprises a radially inner arcuate wall segment 12 and a larger, radially outer arcuate wall segment 14, connected by diverging, radially-oriented side plates 16, 18. The aft or outlet end of the sector nozzle is provided with an apertured plate 20 formed with an array of fuel/air nozzle orifices 22. It will be understood that plural similar sector nozzles 10 will be assembled in an annular array about a combustor center nozzle (see center nozzle 44 in FIG. 8). The invention is not limited, however, to any specific sector nozzle or apertured plate configuration.

In the exemplary but nonlimiting embodiment, a side plate leaf seal assembly 24 is attached to one of the diverging, radially-oriented side plates of each sector nozzle (side plate 18 in this example) such that the seal assembly 24 will, in use, engage a substantially flat, radially-oriented side plate of an adjacent sector nozzle. In other words, and as viewed in FIG. 1, the right side plate 18 supports an exemplary seal assembly 24, while the left side plate 16 is substantially flat and will be engaged by a similar seal assembly 24 on the right side plate of an adjacent sector nozzle (not shown in FIG. 1).

With additional reference to FIGS. 2-7, the side plate leaf seal assembly 24 includes a plurality of convex, metal leaf springs or spring fingers 26 which are joined along a solid radially-extending edge or base 28 at the forward end of the seal assembly (the end remote from the apertured plate 20). The spring fingers 26 and edge or base 28 may be formed from a single metal sheet that is slotted to form the adjacent spring fingers 26. Thus, axially-extending slots 30 are open at the aft end of the spring fingers and terminate at the radially-extending edge or base 28. Note that slots 30 terminate at enlarged openings 32 which allow the spring fingers 26 to flex more freely. The radially inner and outer spring fingers may be formed with a partial cut-out 33 (one shown in FIG. 4) for the same purpose.

The spring fingers 26 are convexly-curved in an axial direction, such that they bow outwardly to enable resilient, sealing engagement with the flat side plate of an adjacent sector nozzle. More specifically, the edge or base 28 and the remote free ends 34 of the spring fingers are substantially flat, with the convexly curved portions extending therebetween. In an exemplary but nonlimiting embodiment, best appreciated from FIGS. 3, 5 and 6, a pair of leaf spring assemblies 24 are welded together, in a nested relationship along their respective bases 28, but with the spring fingers 27 staggered in a radial direction so that, as viewed in FIG. 3, the underlying spring fingers 27 overlap the slots 30 between spring fingers 26, thereby enhancing the sealing effectiveness by reducing potential leakage paths.

The radially inner and outer ends of the spring finger assembly 24 are provided with substantially identical, relatively rigid end plates 36, 38 that lie in axially-extending planes and are substantially perpendicular to the edge or base 28. The outer end plate 36 is of a relatively simple, flat, rectangular shape and is welded to the edge or base 28, but not to the adjacent spring finger 26. The inner end plate 38 is similarly shaped and attached to the edge or base 28, but again, not to the adjacent spring finger. For the inner end plate 38, however, the radially inner surface 40 may be arched or concavely curved (see FIG. 6) to generally conform to the annular spring finger seal 42 on the center nozzle 44 (see also FIGS. 8 and 9) with which it is engaged.

Figure 9:
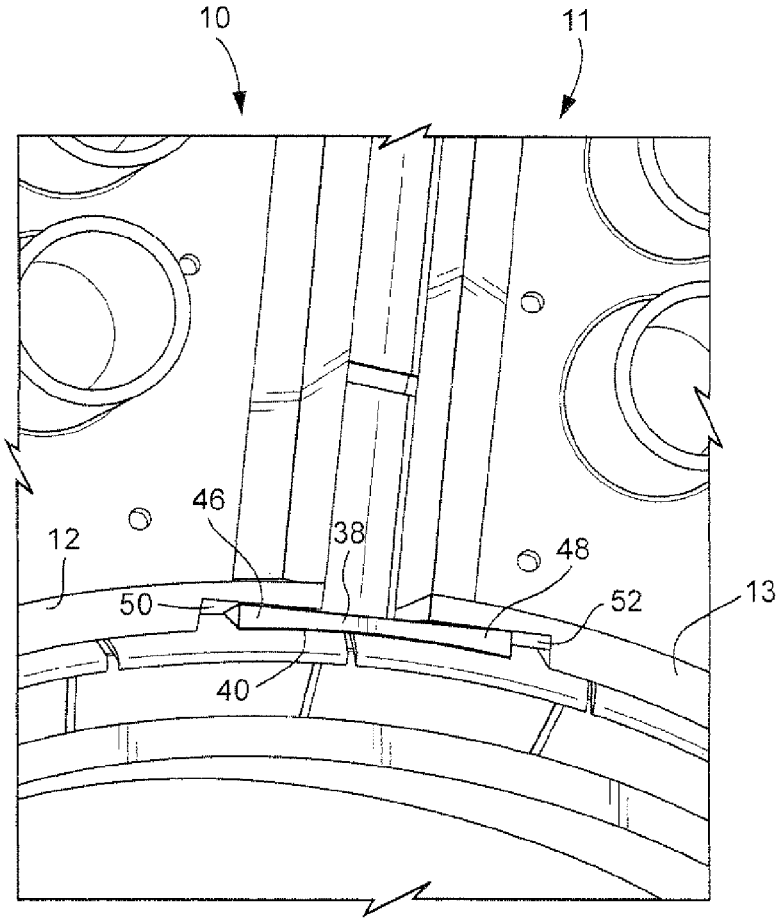
FIG. 9 is a partial perspective view showing the inner end plate of the side plate leaf seal engaged with the center nozzle hula seal.

With reference now to FIG. 9, it may be seen that transverse edges 46, 48 of the inner end plate 38 may be received in notches 50, 52 formed in the adjacent inner wall segments, 12, 13 of adjacent sector nozzles 10, 11 thereby permitting the radially inner surface of the end plate 38 to remain substantially flush with the radially inner surfaces of the inner wall segments 12, 13. A similar notched arrangement in the adjacent sector nozzles may be provided in the outer segment walls for accommodating the radially outer end plate 36.

Figure 10:
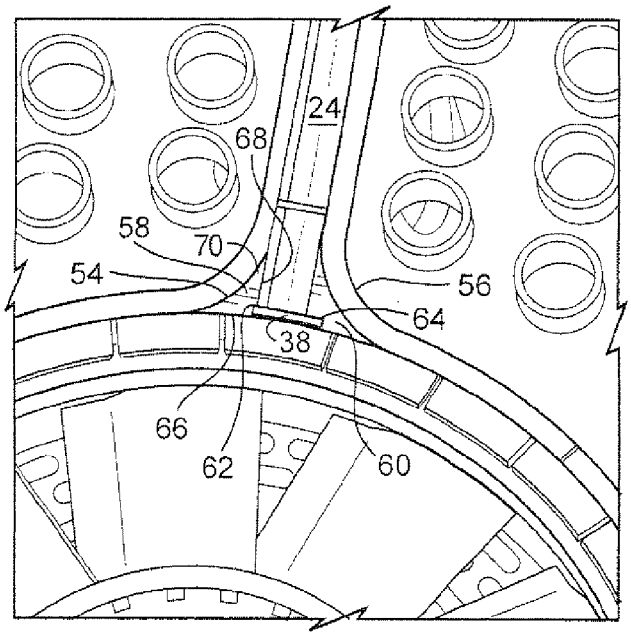
FIG. 10 illustrates an alternative exemplary embodiment wherein seal wedges are added to rounded nozzle corners to facilitate a better fit with the side inner end plate of the plate leaf seal.
Figure 11:
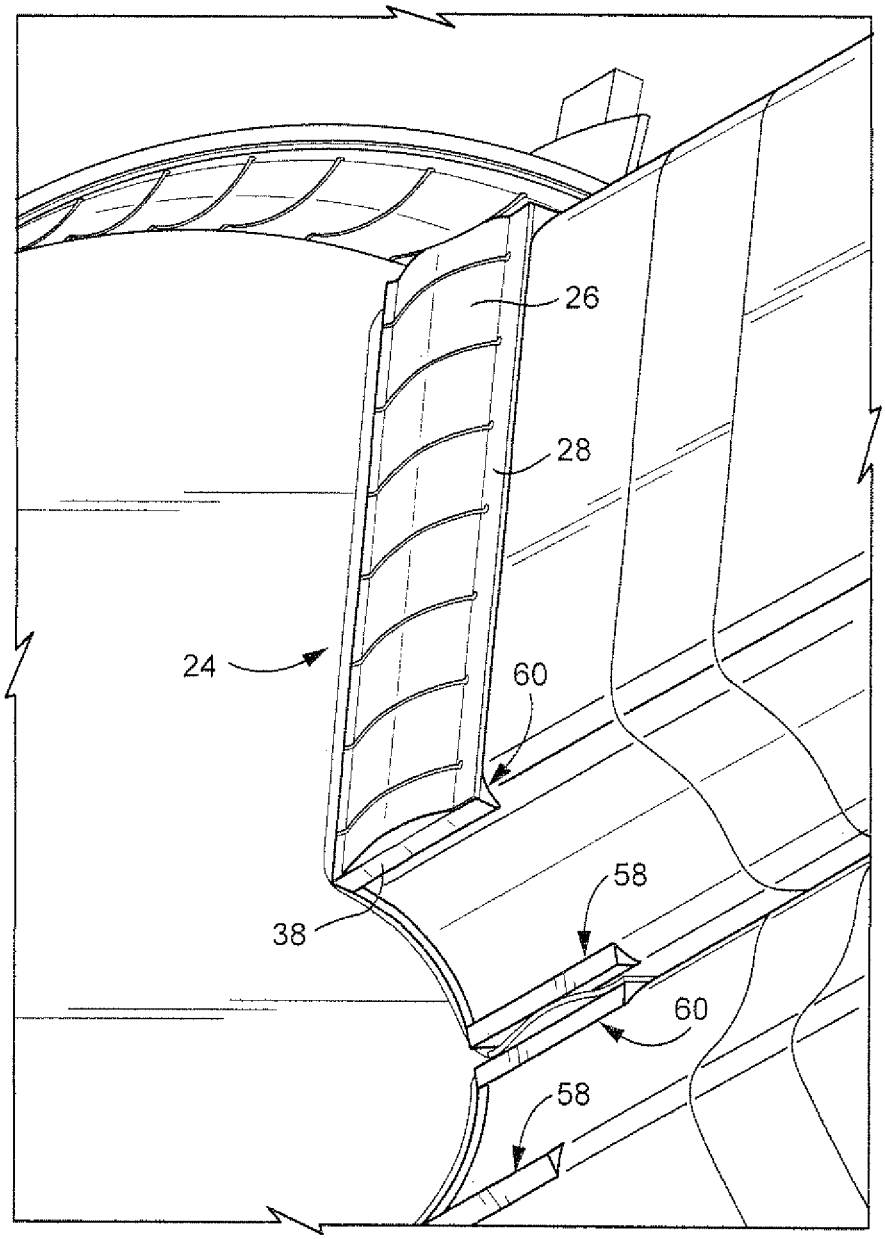
FIG. 11 is a partial perspective view showing plural pairs of the seal wedges shown in FIG. 10.

With reference now to FIG. 10, in the event the inner and/or nozzle sector side plates are rounded (see rounded corners 54, 56), it may be advantageous to weld a pair of elongated, axially-oriented shape-adaptor elements or seal wedges 58, 60 to the adjacent corners to facilitate assembly of the side plate leaf seal assembly 24, and to obtain more effective sealing at the rounded inner corners by eliminating empty space that might otherwise provide a leakage path of adjacent sector nozzles. In addition, the seal wedges 58, 60 may also be notched or grooved as at 62, 64 to receive the transverse edges of the inner end plate 38 of the leaf seal assembly 24, for essentially the same reasons as applied in connection with the arrangement in FIG. 9. The seal wedges 58, 60 are elongate, generally triangular-shaped elements as best seen in FIG. 11 each having a pair of substantially flat sides 66, 68 joined by a curved surface 70. The seal wedges are adapted to be welded to the curved corners 54, 56 such that the curved surface 70 engages the similarly curved nozzle surfaces, as best seen in FIGS. 10 and 11.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A substantially wedge-shaped sector nozzle comprising a nozzle body having inner and outer arcuate segments connected by diverging radially-oriented side plates and a nozzle plate at an aft end of the nozzle body formed with an array of fuel orifices; one of said diverging radially-oriented side plates supporting a radially-oriented leaf seal assembly adapted to seal against a flat plate of an adjacent similarly-shaped sector nozzle.

2. The substantially wedge-shaped sector nozzle of claim 1 wherein said radially-oriented leaf seal assembly comprises a plurality of radially-aligned, axially-extending spring fingers joined along a solid, radially-extending edge.

3. The substantially wedge-shaped sector nozzle of claim 2 and further comprising first and second axially-extending end-plates fixed at opposite radially outer and inner ends of said solid, radially-extending edge.

4. The substantially wedge-shaped sector nozzle of claim 3 wherein said first and second axially-extending end-plates are substantially parallel to each other and lie in planes that are substantially perpendicular to said solid, radially-extending edge.

5. The substantially wedge-shaped sector nozzle of claim 3 wherein said plurality of radially-aligned, axially-extending spring fingers are convexly-curved along at least part of a length dimension thereof.

6. The substantially wedge-shaped sector nozzle of claim 3 wherein said one of said diverging radially-oriented side plates is notched to receive one edge of said second axially-extending end plate.

7. The substantially wedge-shaped sector nozzle of claim 3 wherein one of said first and second axially-extending end-plates is formed with an arched radially inner surface.

8. The substantially wedge-shaped sector nozzle of claim 3 wherein a shape adaptor element is secured at a radially inner end of the sector nozzle, said shape adaptor element formed with an axially-extending groove, and wherein a radially inner one of said first and second axially-extending end plates has an edge seated in said axially-extending groove.

9. A wedge-shaped sector nozzle for a gas turbine combustor comprising:

a nozzle body having inner and outer arcuate segments connected by diverging radially-oriented side plates; and a nozzle plate at an aft end of the nozzle body, the nozzle plate including an array of fuel orifices;

wherein at least one of said diverging radially-oriented side plates is configured to support a radially-oriented seal assembly adapted to seal against a side plate of an adjacent wedge-shaped sector nozzle; and the seal assembly is configured to provide a seal integral with the at least one of the diverging radially-oriented side plates of the wedge-shaped sector nozzle, said seal assembly comprising a plurality of substantially parallel spring fingers joined along a solid edge perpendicular to said plurality of substantially parallel spring fingers, and a pair of relatively rigid inner and outer plates attached at opposite ends of said solid edge.

10. The wedge-shaped sector nozzle of claim 9 wherein said pair of relatively rigid inner and outer plates lie in planes that are substantially parallel to one another and substantially perpendicular to said solid edge.

11. The wedge-shaped sector nozzle of claim 10 wherein at least said relatively rigid inner end plate has a substantially flat radially outer surface and an arched radially inner surface.

12. The wedge-shaped sector nozzle of claim 9 including a second plurality of substantially parallel spring fingers joined along a second solid edge, said plurality and second plurality of substantially parallel spring fingers being nested but offset radially, said solid edge and said second solid edge welded together along respective length dimensions thereof.

13. A pair of wedge-shaped sector nozzles for a gas turbine combustor, each wedge-shaped sector nozzle comprising:

a nozzle body having inner and outer arcuate segments connected by diverging radially-oriented side plates; and a nozzle plate at an aft end of the nozzle body, the nozzle plate including an array of fuel orifices;

wherein at least one of said diverging radially-oriented side plates is configured to support a radially-oriented leaf seal assembly adapted to seal against a side plate of an adjacent wedge-shaped sector nozzle; and wherein said inner and outer arcuate segments comprise, respectively, inner and outer arcuate segment walls;

each inner and outer arcuate segment wall comprises respective first and second axially-oriented edges;

said inner arcuate segment wall is configured to be connected to said outer arcuate segment wall along said respective first and second axially-oriented edges by said diverging radially-oriented side plates.

14. The pair of wedge-shaped sector nozzles of claim 13 wherein said radially-oriented leaf seal assembly comprises a plurality of radially-aligned, axially-extending spring fingers joined along a solid, radially-extending edge.

15. The pair of wedge-shaped sector nozzles of claim 14 and further comprising first and second axially-extending end-plates fixed at opposite radially outer and inner ends of said solid, radially-extending edge.

16. The pair of wedge-shaped sector nozzles of claim 15 wherein said first and second axially-extending end-plates are substantially parallel to each other and lie in planes that are substantially perpendicular to said solid, radially-extending edge.

17. The pair of wedge-shaped sector nozzles of claim 15 wherein said plurality of radially-aligned, axially-extending spring fingers are convexly-curved along at least part of a length dimension thereof.

18. The pair of wedge-shaped sector nozzles of claim 17 wherein said at least one of said diverging radially-oriented side plates is notched to receive one edge of said second axially-extending end plate.

19. The pair of wedge-shaped sector nozzles of claim 15 wherein at least the second axially-extending end-plate is formed with an arched radially inner surface.

20. The pair of wedge-shaped sector nozzles of claim 15 wherein a shape adaptor element is secured at a radially inner end of the wedge-shaped sector nozzle, said shape adaptor element formed with an axially-extending groove, and wherein a radially inner one of said first and second axially-extending end plates has an edge seated in said axially-extending groove.

21. A wedge-shaped sector nozzle configured to be arranged as part of a series of like wedge-shaped sector nozzles placed adjacently and circumferentially around a center nozzle, the sector nozzle comprising:

an inner arcuate segment configured to engage the center nozzle;

an outer arcuate segment located radially outward from and concentric with the inner arcuate segment;

a first radially-oriented side plate extending from the inner arcuate segment to the outer arcuate segment;

a second radially-oriented side plate extending from the inner arcuate segment to the outer arcuate segment; and an aft-facing plate located between the first radially-oriented side plate and the second radially-oriented side plate and also radially between the inner arcuate segment and the outer arcuate segment;

wherein:

the aft-facing plate is provided with an array of nozzle orifices;

the first radially-oriented side plate provides a flat surface configured to couple with an adjacent second wedge-shaped sector nozzle via a second sector nozzle second radially-oriented side plate;

the second radially-oriented side plate is configured to support a radially-oriented leaf seal assembly; and the radially oriented leaf seal assembly is configured to create a seal with a flat surface of an adjacent third wedge-shaped sector nozzle via a third sector nozzle first radially-oriented side plate.

* * * * *